US009574402B2

(12) United States Patent
Hause

(10) Patent No.: US 9,574,402 B2
(45) Date of Patent: Feb. 21, 2017

(54) BOX FRAME SPREADER BEAM

(71) Applicant: Nabors Drilling USA, Houston, TX (US)

(72) Inventor: Ryan Hause, Houston, TX (US)

(73) Assignee: Nabors Drilling USA, Houston, TX (US)

( * ) Notice: Subject to any disclaimer, the term of this patent is extended or adjusted under 35 U.S.C. 154(b) by 451 days.

(21) Appl. No.: 14/174,646

(22) Filed: Feb. 6, 2014

(65) Prior Publication Data

US 2014/0224541 A1 Aug. 14, 2014

Related U.S. Application Data

(60) Provisional application No. 61/763,790, filed on Feb. 12, 2013.

(51) Int. Cl.
*E21B 7/02* (2006.01)
*E21B 15/00* (2006.01)

(52) U.S. Cl.
CPC ..... *E21B 7/02* (2013.01); *E21B 15/003* (2013.01)

(58) Field of Classification Search
CPC ..... E21B 19/155; E21B 15/00; E21B 7/023; E21B 7/02; E21B 15/003; E04H 12/18; E04H 12/182; E04G 25/04
USPC ..... 52/123.1, 745.17, 745.18
See application file for complete search history.

(56) References Cited

U.S. PATENT DOCUMENTS 2,923,381 A * 2/1960 Wilkinson ..... E04H 12/34 52/115
3,385,014 A * 5/1968 Haug ..... B62D 55/084 173/90
6,594,960 B2 * 7/2003 Brittain ..... E21B 15/00 175/202
7,716,897 B2 * 5/2010 Merrifield ..... B64G 1/222 52/118
7,914,042 B2 * 3/2011 Andersen ..... B65G 69/003 280/762
2008/0063498 A1 * 3/2008 Lambert ..... B66F 11/04 414/540
2013/0180185 A1 * 7/2013 Ferrari ..... E21B 15/00 52/117
2013/0341037 A1 * 12/2013 Flusche ..... E21B 19/155 166/379

* cited by examiner

*Primary Examiner* — Michael Wills, III
(74) *Attorney, Agent, or Firm* — Adolph Locklar

(57) ABSTRACT

A spreader beam includes a first spreader beam section, where the first spreader beam section is pivotably coupled to the first substructure and a second spreader beam section, where the second spreader beam section is pivotably coupled to the second substructure. The first and second spreader beam sections are positioned to, in an extended position, selectively couple to each other.

20 Claims, 2 Drawing Sheets

BOX FRAME SPREADER BEAM

CROSS-REFERENCE TO RELATED APPLICATIONS

This application is a non-provisional application which claims priority from U.S. provisional application No. 61/763,790, filed Feb. 12, 2013.

FIELD OF THE DISCLOSURE

The present disclosure relates generally to support structures, and particularly to rig support structures for use in oil drilling rigs.

BACKGROUND OF THE DISCLOSURE

Box-on-box style land-based drilling rigs are made up of multiple stacked girder-framed box substructure. Swing-up or self-elevating style land-based drilling rigs are made up of a top, girder-frame box coupled, by pivoting elevator legs, to a bottom, girder-frame box substructure. Typically, hardware known as spreader beams may be used to, for example keep parallel box substructures in relative alignment along, for example, each side of a wellbore or well-center. Conventional spreader beams are pinned in place, and either require complete removal or allow only horizontal rotation. Land-based drilling rigs may be skidded from location to location to drill multiple wells within the same well site. In certain situations, it is necessary to skid the drilling rig across an already drilled well for which there is a well-head in place. In these situations, the spreader beams must be removed completely to allow the rig to traverse any such obstructions. Once the rig has been skidded, the spreader beams may be replaced. Spreader beams may be located near the ground, in some cases within three feet of ground level.

SUMMARY

A spreader beam for coupling between a first and a second parallel substructure is disclosed. The spreader beam includes a first spreader beam section, where the first spreader beam section is pivotably coupled to the first substructure, and a second spreader beam section, where the second spreader beam section is pivotably coupled to the second substructure. The first and second spreader beam sections are positioned to, in an extended position, selectively couple to each other.

The present disclosure also provides for a method. The method may include positioning a drilling rig at a first position in a wellsite. The drilling rig may include a first and a second parallel substructure; a spreader beam positioned to couple between the first and second parallel substructures. The spreader beam may include: a first spreader beam section, the first spreader beam section pivotably coupled to the first substructure; a second spreader beam section, the second spreader beam section pivotably coupled to the second substructure; the first and second spreader beam sections positioned to, in an extended position, selectively couple to each other. The method may further include decoupling the first and second spreader beam sections; pivoting the first and second spreader beam sections to a retracted position; moving the drilling rig to a second position.

The present disclosure also provides for a spreader beam for coupling between a first and a second parallel substructure of a drilling rig. The spreader beam may include a first spreader beam section. The first spreader beam section may be pivotably coupled to the first substructure. The first spreader beam section may be pivotable in at least one of a horizontal plane and a vertical plane. The first spreader beam section may include a first spreader beam subsection and a second spreader beam subsection, the first and second spreader beam sections being slidingly coupled such that by extending the second spreader beam subsection past the first spreader beam subsection, the length of the spreader beam section is increased. The spreader beam may also include a second spreader beam section. The second spreader beam section may be pivotably coupled to the second substructure, the second spreader beam section may be pivotable in at least one of a horizontal plane and a vertical plane. The first and second spreader beam sections may be positioned to, in an extended position, selectively couple to each other.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
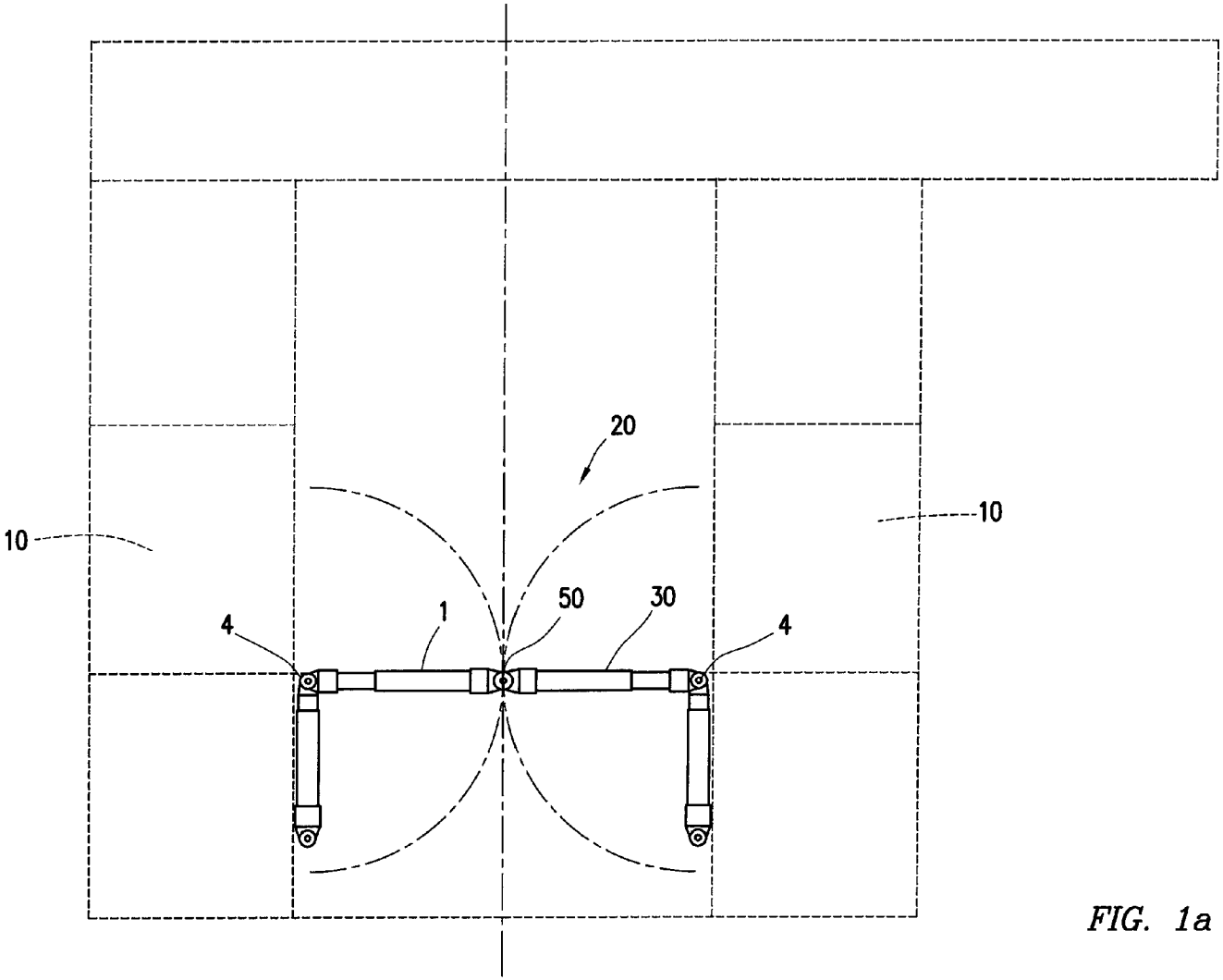
FIG. 1*a* is an end view of a section of a box-on-box drilling rig consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1*a* depicts box-on-box rig 20. Box-on-box rig 20 may include two parallel substructures 10. Substructures 10 may be maintained a selected distance from each other by means of one or more spreader beams 30. In one embodiment, spreader beam 30 includes spreader beam sections 1. Each spreader beam section 1 is attached to a corresponding substructure 10 at a corresponding spreader beam joint 4. In normal operation, spreader beam sections 1 may be joined by center spreader beam coupler 50.

During a skidding operation, box-on-box rig 20 may need to traverse an obstruction, such as a wellhead, which is straddled by substructures 10 as box-on-box rig 20 skids thereover. When skidding past an obstruction taller than the distance between ground level and spreader beams 30, spreader beams 30 may interfere with the obstruction and prevent box-on-box rig 20 from traversing the obstruction. In some embodiments, spreader beam sections 1 may be decoupled at spreader beam coupler 50. In some embodiments, each spreader beam section 1 may be pivotably coupled to a corresponding substructure 10, thus allowing spreader beam section 1 to pivot out of the way once decoupled at spreader beam coupler 50. As depicted in FIG. 1*a*, spreader beam sections 1 may pivot upward and downward at spreader beam joints 4. In some embodiments, spreader beam sections 1 may instead be positioned to pivot horizontally about spreader beam joints 4. In some embodiments, spreader beam joints 4 may be universal joints which may be used to allow spreader beam sections 1 to pivot both upward and downward, as well as horizontally. Once spreader beam sections 1 are decoupled and temporarily pivoted out of the way, box-on-box rig 20 may continue to skid over the obstruction. Once the obstruction is cleared, spreader beam sections 1 may be recoupled by spreader beam coupler 50. In some embodiments, a locking mechanism may be included on one or more of substructure 10 or spreader beam section 1, allowing spreader beam sections 1 to be retained against substructure 10 to, for example, prevent them from freely moving during the skidding operation or during transportation.

In some embodiments of the present disclosure, each spreader beam section 1 may include two or more sections positioned to, for example, telescope and increase the length of spreader beam section 1. By reducing in length, spreader beams 1 may, for example in a situation in which the distance between substructures 10 is greater than one half the distance between spreader beam 30 and ground level, allow spreader beams 1 to be secured to substructures 10 in the downward position without, for example, dragging on the ground as box-on-box rig 20 is skidded.

Figure 1B:
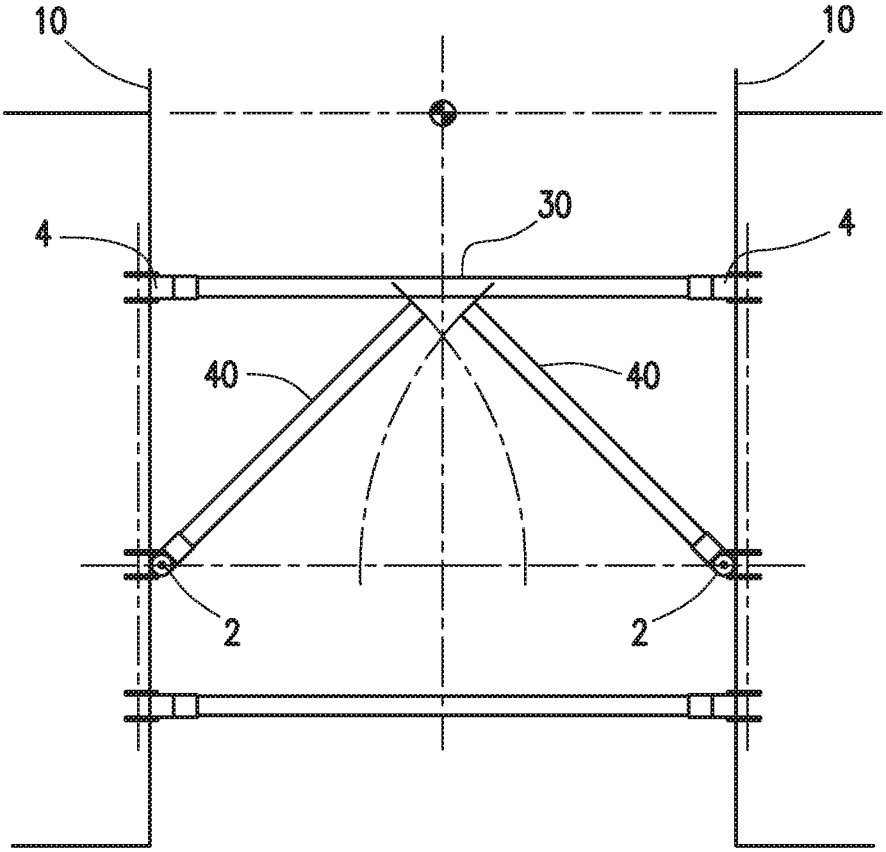
FIG. 1*b* is a plan view of a section of a box-on-box drilling rig consistent with at least one embodiment of the present disclosure.

In some embodiments, such as that depicted in FIG. 1*b*, spreader beam 30 may be reinforced by one or more k-braces 40. K-braces 40 may provide support to spreader beams 30 and, for example, increase the rigidity of substructures 10. When skidding past an obstruction greater than the distance between ground level and K-braces 40 and spreader beams 30, K-beams 40 may be configured to be removed by, for example, unbolting or unpinning. In some embodiments of the present disclosure, K-braces 40 may be pivotably coupled to substructures 10 by K-brace joints 2. In some embodiments, K-brace joints 2 may allow for the pivoting of K-braces in a horizontal axis or a vertical axis. In some embodiments, K-brace joints 2 may be adapted to allow for the pivoting of K-braces 40 in both horizontal and vertical directions. In some embodiments, K-braces 40 may be coupled to spreader beam segments 1. In some embodiments, K-braces 40 may be positioned to pivot upward or downward as spreader beam segments 1 pivot upward or downward. In some embodiments, a locking mechanism may be included on one or more of substructure 10 or K-braces 40, allowing K-braces 40 to be retained against substructure 10 to, for example, prevent them from freely moving during the skidding operation.

In some embodiments, spreader beams 30 and/or K-braces 40 may be located within 5 feet of the ground level. In some embodiments, spreader beams 30 and/or K-braces 40 may be located at least 6 feet above ground level. In other embodiments, K-braces 40 and/or spreader beams 30 may be located between about 5-8 feet above ground level. In some embodiments, K-braces 40 and/or spreader beams 30 may be located about 7 feet above ground level. By locating K-braces 40 and spreader beams 30 higher above ground level, obstructions such as well-heads may be skidded over without removal or reconfiguration of spreader beams 30 and K-braces 40.

In some embodiments, K-braces 40 may be at an angle of between about 20° and 75° to spreader beams 30. In some embodiments, K-braces 40 may be at an angle of between about 30° and 60° to spreader beams 30. In some embodiments, K-braces 40 may be at an angle about 45° to spreader beams 30.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

What is claimed is:

1. A spreader beam for coupling between a first and a second parallel substructure of a drilling rig, the spreader beam comprising:

a first spreader beam section, the first spreader beam section pivotably coupled to the first substructure of the drilling rig;

a second spreader beam section, the second spreader beam section pivotably coupled to the second substructure of the drilling rig;

the first and second spreader beam sections positioned to, in an extended position, selectively couple to each other and, in a retracted position, decouple from each other.

2. The spreader beam of claim 1, wherein the first spreader beam section is pivotably coupled to the first substructure such that the first spreader beam is pivotable in a horizontal plane.

3. The spreader beam of claim 1, wherein the first spreader beam section is pivotably coupled to the first substructure such that the first spreader beam is pivotable in a vertical plane.

4. The spreader beam of claim 1, wherein the first spreader beam section is pivotably coupled to the first substructure such that the first spreader beam is pivotable in both a horizontal plane and a vertical plane.

5. The spreader beam of claim 1, wherein the first spreader beam section is selectively coupleable to the first substructure when in a retracted position.

6. The spreader beam of claim 1, wherein the first spreader beam section further comprises a first spreader beam subsection and a second spreader beam subsection, the first and second spreader beam subsections being slidingly coupled such that by extending the second spreader beam subsection past the first spreader beam subsection, the length of the first spreader beam section is increased.

7. The spreader beam of claim 1, further comprising a first K-brace, the first K-brace coupled between the first substructure and the first spreader beam section, the first K-brace coupled to the first substructure at a point spaced apart from the point at which the first spreader beam section is coupled to the first substructure.

8. The spreader beam of claim 7, wherein the first K-brace is pivotably coupled to the first substructure.

9. The spreader beam of claim 8, wherein the first K-brace may pivot while coupled to the first spreader beam section as the first spreader beam section is pivoted into a retracted position.

10. A method comprising:

positioning a drilling rig at a first position in a wellsite, the drilling rig including:

a first and a second parallel substructure;

a spreader beam positioned to couple between the first and second parallel substructures, the spreader beam including:

a first spreader beam section, the first spreader beam section pivotably coupled to the first substructure;

a second spreader beam section, the second spreader beam section pivotably coupled to the second substructure;

the first and second spreader beam sections positioned to, in an extended position, selectively couple to each other;

decoupling the first and second spreader beam sections;

pivoting the first and second spreader beam sections to a retracted position;

moving the drilling rig to a second position.

11. The method of claim 10, further comprising:

pivoting the first and second spreader beam sections to the extended position;

recoupling the first and second spreader beam sections.

12. The method of claim 10, wherein the first spreader beam section is pivotably coupled to the first substructure such that the first spreader beam pivots in a horizontal plane.

13. The method of claim 10, wherein the first spreader beam section is pivotably coupled to the first substructure such that the first spreader beam pivots in a vertical plane.

14. The method of claim 10, wherein the first spreader beam section is pivotably coupled to the first substructure such that the first spreader beam pivots in both a horizontal plane and a vertical plane.

15. The method of claim 10, further comprising:

coupling the first spreader beam section to the first substructure when in the retracted position.

16. The method of claim 10, wherein the first spreader beam section further comprises a first spreader beam subsection and a second spreader beam subsection, the first and second spreader beam subsections being slidingly coupled such that by extending the second spreader beam subsection past the first spreader beam subsection, the length of the first spreader beam section is increased.

17. The method of claim 10, further comprising a first K-brace, the first K-brace coupled between the first substructure and the first spreader beam section.

18. The method of claim 17, wherein the first K-brace is pivotably coupled to the first substructure.

19. The method of claim 18, further comprising pivoting the first K-brace while coupled to the first spreader beam section as the first spreader beam section is pivoted into the retracted position.

20. A spreader beam for coupling between a first and a second parallel substructure of a drilling rig, the spreader beam comprising:

a first spreader beam section, the first spreader beam section pivotably coupled to the first substructure, the first spreader beam section pivotable in at least one of a horizontal plane and a vertical plane, the first spreader beam section including:

a first spreader beam subsection and a second spreader beam subsection, the first and second spreader beam subsections being slidingly coupled such that by extending the second spreader beam subsection past the first spreader beam subsection, the length of the first spreader beam section is increased;

a second spreader beam section, the second spreader beam section pivotably coupled to the second substructure, the second spreader beam section pivotable in at least one of a horizontal plane and a vertical plane;

the first and second spreader beam sections positioned to, in an extended position, selectively couple to each other and, in a retracted position, decouple from each other.

* * * * *